United States Patent [19]

White

[11] 4,368,935

[45] Jan. 18, 1983

[54] VERTICAL FILING SYSTEM

[75] Inventor: David A. White, Folcroft, Pa.

[73] Assignee: United Filing Corporation, Claymont, Del.

[21] Appl. No.: 187,946

[22] Filed: Sep. 16, 1980

[51] Int. Cl.[3] ..... A47B 63/00

[52] U.S. Cl. ..... 312/184; 312/189; 248/206 A

[58] Field of Search ..... 312/184, 188, 187, 189; 248/206 A

[56] References Cited

U.S. PATENT DOCUMENTS

| | | | |
|---|---|---|---|
| 1,416,661 | 5/1922 | Barnhart | 312/184 |
| 2,205,903 | 6/1940 | Mobus | 312/184 |
| 2,747,501 | 5/1956 | Latimer | 248/206 A |
| 3,312,514 | 4/1967 | Barker | 312/184 |
| 3,312,517 | 4/1967 | Barker | 312/184 |
| 3,865,445 | 2/1975 | Dean et al. | 312/184 |
| 4,139,248 | 2/1979 | Hornbacher | 312/184 |
| 4,303,284 | 12/1981 | Johnson | 312/189 |

FOREIGN PATENT DOCUMENTS

| | | | |
|---|---|---|---|
| 512086 | 4/1955 | Canada | 312/184 |
| 2844798 | 4/1979 | Fed. Rep. of Germany | 312/184 |
| 1153865 | 3/1958 | France | 312/184 |
| 903214 | 8/1962 | United Kingdom | 312/184 |
| 1027347 | 4/1966 | United Kingdom | 312/184 |

OTHER PUBLICATIONS

Dutch Reference, Trade Brochure To Archlvite, Feb., 1980.

*Primary Examiner*—Victor N. Sakran

*Attorney, Agent, or Firm*—Mortenson & Uebler

[57] ABSTRACT

A vertical filing system is provided wherein documents are filed in the spaces between a plurality of filing bars contained in a cabinet by hanging the documents on pins extending through the bars and outwardly into the spaces. In the closed, filing position, the pins extending from any one bar extend into the space between bars and overlap the pins extending into the space from an adjacent bar. In the open position, any two adjacent filing bars are separated such that the oppositely coacting pins on adjacent bars do not overlap and documents can be either inserted and filed or removed therefrom. In a preferred embodiment, openings are provided in each filing bar through which pins from adjacent bars can extend, the preferred pin-opening sequence on the filing bars being pin-opening-opening, pin-opening-opening, and so on.

6 Claims, 9 Drawing Figures

VERTICAL FILING SYSTEM

BACKGROUND OF THE INVENTION

The present invention relates to a filing system wherein documents or drawings are vertically suspended and stored and more particularly relates to a filing cabinet where the documents are hung on pins attached to movable file bars.

Many filing systems are known in the prior art disclosing vertically hung drawings and documents wherein the documents are hung on horizontal pins or similar devices. U.S. Pat. No. 4,139,248 discloses a filing system having two sets of coplanar bars which telescopically cooperate with one another and upon which the documents hang upon a special suspension device.

U.S. Pat. No. 1,416,661 also discloses a vertical filing system using horizontal pins. A device is disclosed having two opposed surfaces one of which is movable relative to the other, and having sets of suspension-members (pins) projecting oppositely from the surfaces to conjointly support the documents placed between them. Means are provided to retain a selected number of suspended documents on either side when the surfaces are separated.

U.S. Pat. No. 2,205,903, describes a filing system having a rear wall member and a tiltable front wall member with straight tubular suspension elements pivotally attached for vertical swinging movement to the rear wall and straight pins pivotally attached to the front wall member for vertical swinging movement. The suspension elements and pins telescope to form a rigid support for the drawings in the closed position and disengagement from one another in the fully open position.

Other, less relevant, patents describe hanging devices used to hang documents vertically. U.S. Pat. No. 2,969,793 describes a device used to hang documents vertically between two rails. U.S. Pat. No. 3,865,445 describes another device to hang documents vertically. U.S. Pat. No. 3,734,590 describes a tub file than can utilize vertical file folders hung between the cabinet sides. U.S. Pat. No. 3,899,082 describes a binder storage support.

SUMMARY OF THE INVENTION

A vertical filing system is provided wherein filed documents are suspended vertically on a plurality of oppositely oriented, coacting, substantially horizontal pins, the pins and associated components of the filing system being contained in a filing cabinet which may be either a top opening type or a drawer opening type cabinet. Components of this filing system include: a plurality of substantially horizontal and substantially parallel file bars having pins extending perpendicularly through these bars and protruding outwardly therefrom, the pins extending from any one bar being offset from the pins of any other adjacent bar; the space between each pair of file bars being used to file documents therein by hanging the documents on the pins extending into the space from each bar at each end of the space; means for slideably moving the file bars toward and away from each other within the cabinet; means to vary the possible separation distance between any two of the file bars from a minimum, specified, closed distance to an intermediate, specified, search distance and to a maximum, specified, open distance, the lengths of the pins being such that, when the file bars are at the minimum closed distance, or at said intermediate, search distance, the pins extending into the space from one file bar overlap the pins extending in the opposite direction into the space from an adjacent bar, thereby prohibiting the fall or removal of filed documents from the space and providing convenient and effective storing thereof; the lengths of the pins being such that, when the file bars are at the maximum, open distance, the pins extending into the space from one bar do not overlap the pins extending in the opposite direction into the space from an adjacent bar, thereby providing for vertical filing or removal of documents within or from the spaces between file bars.

The above-mentioned means to vary the possible separation distance between any two file bars is preferably at least one safety block insertable and removable from the space between the cabinet front wall and the first file bar, whereby, when this safety block is inserted, the pins overlap in each space in the closed or search positons, and when the safety block is removed, the pins do not overlap in at least one of the spaces between filing bars.

The safety block is preferably mounted on hinges for easy opening and the block can be held in the open position by means of a magnet.

In a preferred embodiment, pins are located on each filing bar and openings are placed in each bar through which pins of adjacent bars can extend such that, on each file bar, other than the first and last bar, the pin-opening sequence is pin-opening-opening, pin-opening-opening, and so on, the first and last bars having pins and openings to accomodate the internal bars.

The pin-opening arrangement is such that, in one internal bar, the sequence is pin-opening-opening, pin-opening-opening, and so on, and in the next adjacent bar the sequence is opening-pin-opening, opening-pin-opening, and so on, and in the next adjacent bar the sequence is opening-opening-pin, opening-opening-pin, and so on, repeating such sequence for all bars in the system.

With this new filing system, compact filing is achieved and efficient and convenient searching of filed documents, and removal of desired documents from the system is readily achieved.

DETAILED DESCRIPTION OF THE INVENTION AND PREFERRED EMBODIMENT WITH REFERENCE TO THE DRAWINGS

A vertical filing system is provided wherein documents are filed in the spaces between a plurality of filing bars contained in a cabinet by hanging the documents on pins extending through the bars and outwardly into the spaces. In the closed, filing position, the pins extending from any one bar extend into the space between bars and overlap the pins extending into the space from an adjacent bar. In the open position, any two adjacent filing bars are separated such that the oppositely coacting pins on adjacent bars do not overlap and documents can be either inserted and filed or removed therefrom. In a preferred embodiment, openings are provided in each filing bar through which pins from adjacent bars can extend, the preferred pin-opening sequence on the filing bars being pin-opening-opening, pin-opening-opening, and so on.

Figure 1:
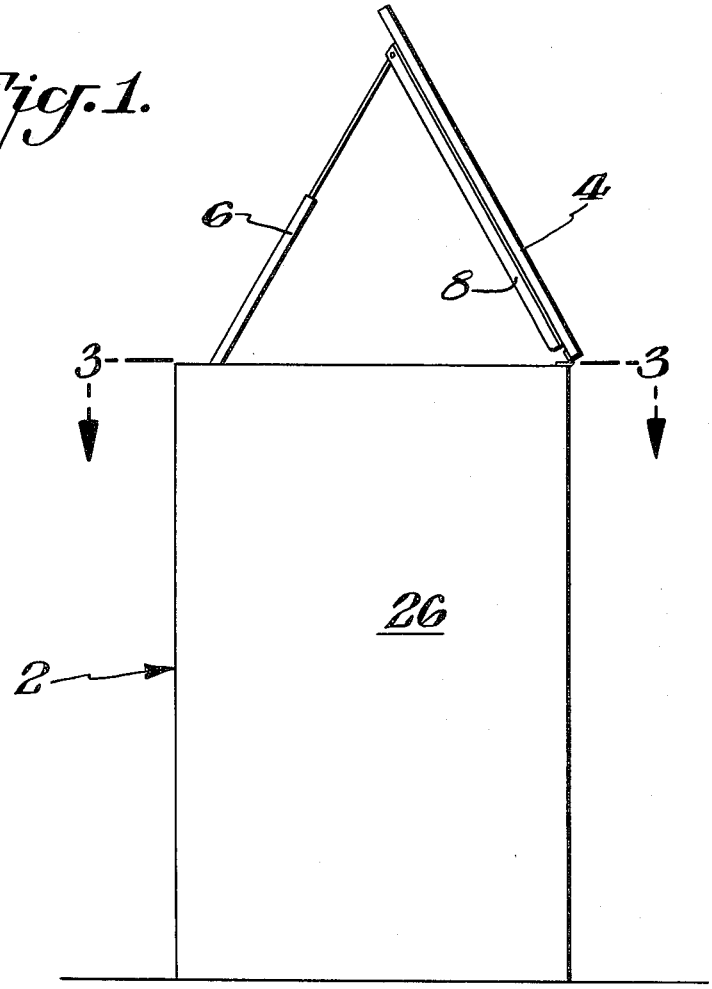
FIG. 1 is a side elevational view of a top opening vertical filing cabinet of this invention.

FIGS. 1 through 9 set forth in detail the filing system of this invention. The filing system of this invention can be contained in either a top loading or a front loading cabinet. A top loading cabinet is shown in FIG. 1 wherein the lid 4 and the attached lid support brace 8 are opening into the cabinet 2. Gas spring 6, for example, is used to hold the lid open for filing and is mounted to the lid support brace 8 at one end and the cabinet 2 at the other.

Figure 2:
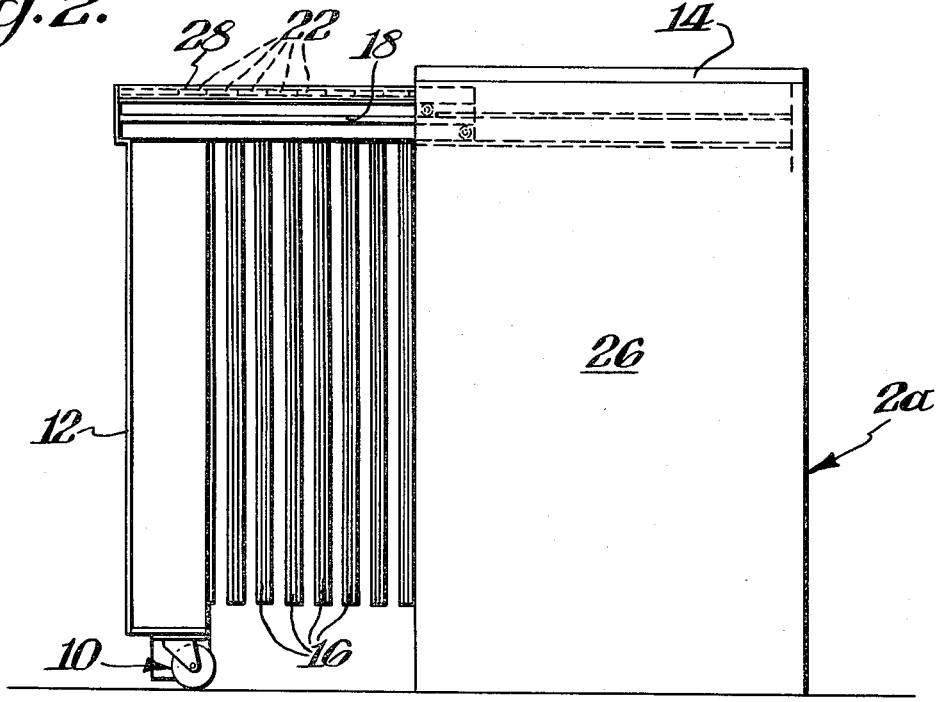
FIG. 2 is a side elevation view of a front opening vertical filing cabinet according to this invention.

FIG. 2 shows the alternate, front loading embodiment. The vertical files 16 can be moved into and out of cabinet 2*a* by means of wheel means 10. For completeness, FIG. 2 illustrates the relative positions of vertical files 16, guide rails 18, file bar sliding blocks 22, U-channel 28 in which the sliding blocks 22 slide and cabinet top 14 and side 26. Guide rail 18 attaches perpendicularly to cabinet front 12 and supports U-channel 28. Sliding blocks 22 for holding the file bars, described more fully hereinbelow, slide within a U-channel 28.

Figures 3, 4:
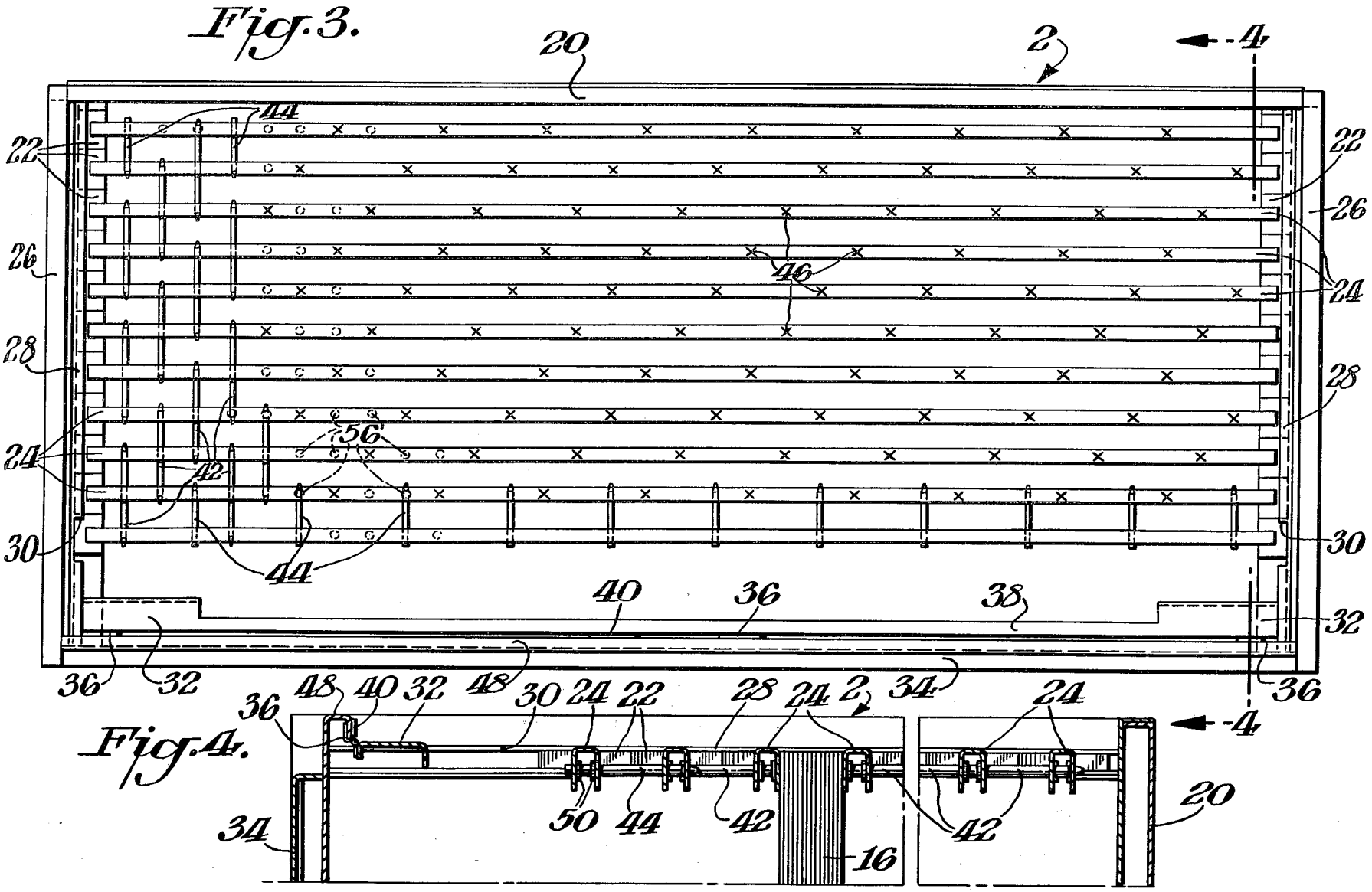
FIG. 3 is a top plan view, in part schematic, of the filing system of this invention.
FIG. 4 is a view taken along line 4—4 of FIG. 3, in part cross-section.

FIG. 3 taken along line 3—3 of FIG. 1 shows the preferred arrangement of the filing system of this invention in a top plan view. Cabinet 2 is comprised of cabinet back 20, cabinet sides 26 and cabinet front and front extension 48. Hinges 36 are secured to cabinet front extension 48. Affixed to the cabinet sides 26 are U-channels 28 in which slide blocks 22 slide. File bars 24 are each affixed to a block 22 at each end therof. Openings 30 in the U-channel assemblies 28 permit blocks 22 and slide bars 24 to be inserted into or removed from the channels 28. Safety blocks 32, shown in closed position, restrict block 22 movement within the U-channel 28. Preferably two safety blocks 32 at each front corner of the cabinet opening are employed as shown connected by bar 38 but it will be clear that alternative embodiments may be used. The first and last file bars 24 contain shorter filing pins 44 which extend as shown only through two filing bars 24 when in the closed positions. Al other filing bars 24 contain pins 42 which extend through three filing bars 24 in the closed position and slightly beyond. Pins 42 or 44 extend into and through the holes 56 in adjacent file bars.

As graphically illustrated in FIG. 3, the file bars 24 extend horizontally across the cabinet opening and are supported at each end thereof by sliding blocks 22 which rest and/or slide in U-channels 28. These blocks and U-channels are preferably made of nylong although any low friction, relatively sturdy material can be used. When the safety blocks 32 are in the closed position as shown, the maximum distance which any file bar 24 can be separated from either adjacent file bar is limited by these safety blocks as discussed more fully below. At this maximum separation distance in the closed position the pins 42 and/or 44 are of sufficient length that the pins in one file bar extend into the opening between the bars to a distance overlapping the pins extending in the opposite direction from the adjacent file bar across the opening. In this way, when safety block 32 is in the closed position, it is not possible for a document hanging on pins 42 or 44 to fall or be removed therefrom.

As also shown in FIG. 3, the preferred pin arrangement in a given bar is in the sequence pin 42-hole-hole, pin 42-hole-hole, etc. The next adjacent bar would then have the sequence of hole-pin 42-hole, hole-pin 42-hole, etc. and, it follows, that the third adjacent bar would have the sequence hole-hole-pin 42, hole-hole-pin 42, and so on for all bars in this system. At the end bars, modified, shorter pins 44 are used as shown.

In the remainder of FIG. 3, the location of the pins is shown schematically by means of the "x"s, 46.

In one preferred embodiment, an eleven bar system is provided having ten filing spaces therebetween. Typically this arrangement could provide 13.75 inches of horizontal filing areas which will file approximately 2750 full size documents of a thickness of 5 mil per document.

It will be clear to one skilled in this art that the specific dimensions, sizes of the components, number of file bars, etc., can be varied without departing from the gist or scope of this invention.

Figure 9:
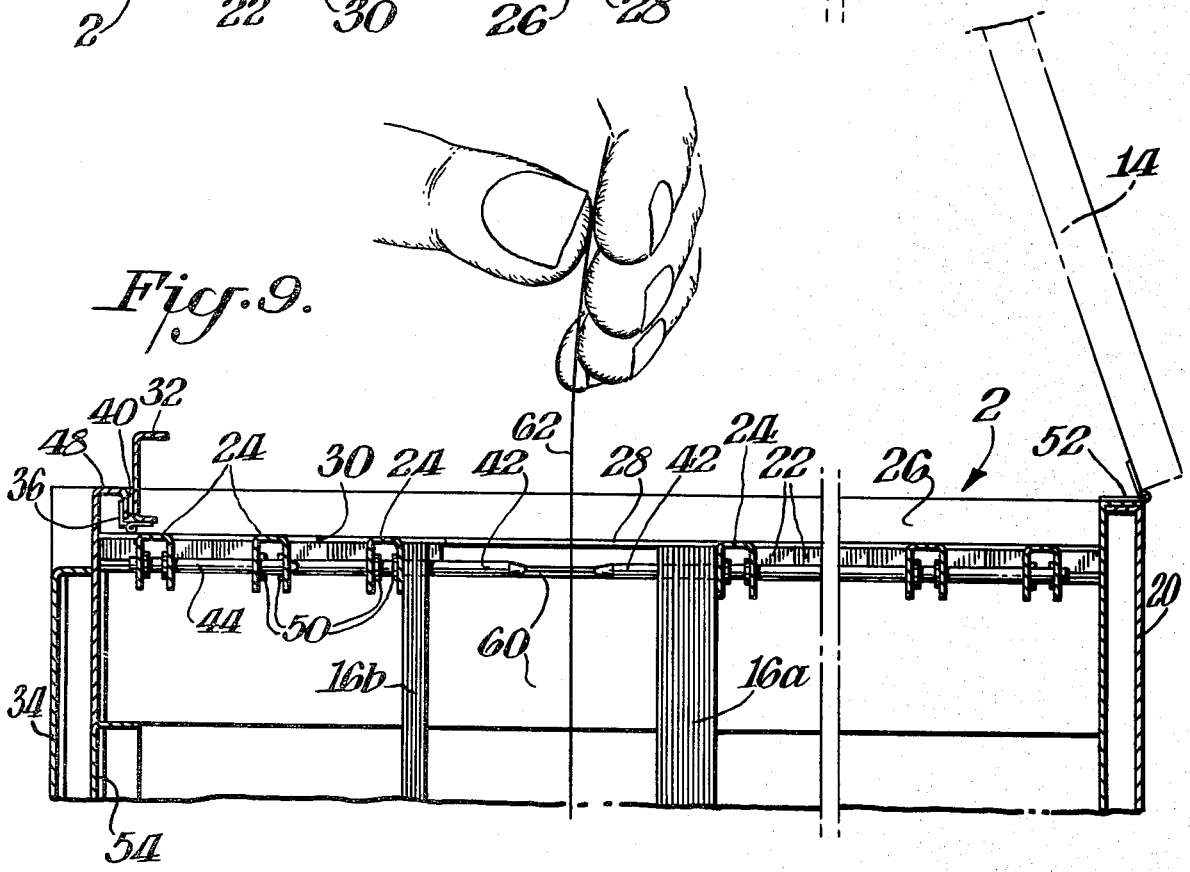
FIG. 9 is a side elevational view, in part cross-section, taken along line 9—9 of FIG. 8 and showing a document being removed from the filing system of this invention.

FIG. 4 taken along line 4—4 of FIG. 3, shows safety block 32 in cross-section in the closed position. Only one set of filed documents 16 is shown for convenience of illustration. The safety block 32 is attached to the cabinet front extension 48 by hinges 36. When open, as shown in FIG. 9, safety block 32 is held in the up position by magnet 40. The slide blocks 22 hold the filing bars 24. Pins 42 are attached to the filing bars 24 at the centers by snap rings 50 such that the pins 42 extend through the respective holes in the adjacent file bars on either side.

Figure 5:
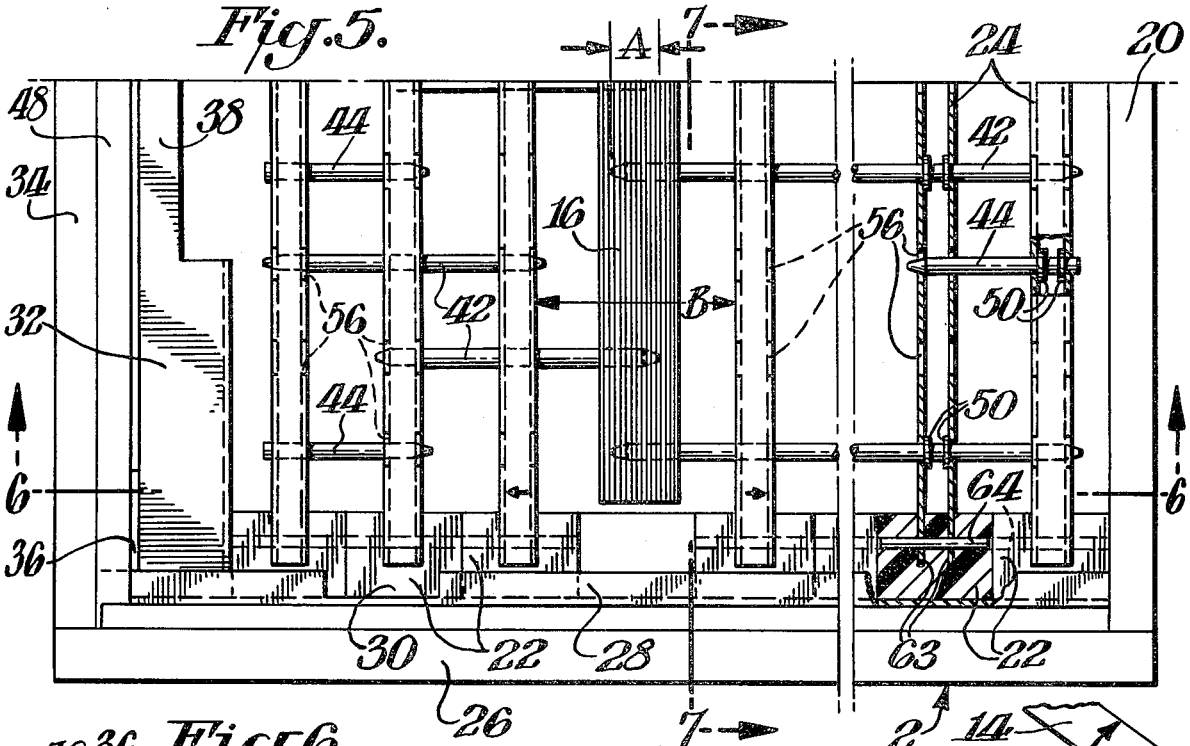
FIG. 5 is a partial exploded top view, in part cross-section, of the filing bars and pin arrangement of the system of this invention with the safety block in the closed position.

In FIG. 5, U-channel 28 is shown attached to cabinet side 26 and contains opening 30 through which blocks 22 can be inserted or removed. The filing bars 24 are inserted in slots 63 of blocks 22, shown in cross-section, and are affixed by retainer pins 64. A plurality of pins 42 are inserted in the indicated holes in the filing bars 24 and attached thereto by snap rings 50. Each file bar 24 contains holes 56 to receive pin 42 from the adjacent file bars 24 on either side arranged in the indicated sequence. Documents 16 hang from filing pins 42 (or pins 44 on the respective first and last file bars). Pins 44 on the first and last filing bars 24 are similar to pins 42 except they are shorter, as shown. Dimension "A" indicates the horizontal overlap distance between the ends of oppositely oriented adjacent pins 42 with the safety blocks 32 in the down, or closed, position. Distance "B" indicates the maximum separation distance between adjacent file bars in the closed position. In FIG. 5, the cabinet structure consisting of cabinet back 20, cabinet front extension 48, and handle 34 are included for completeness.

Figure 6:
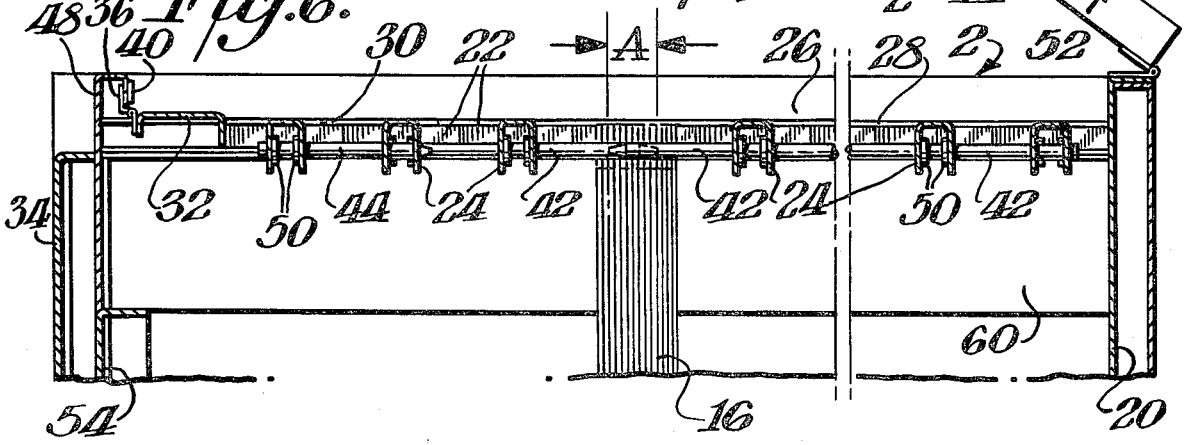
FIG. 6 is a partial exploded view, in part cross-section, taken along line 6—6 of FIG. 5.

FIG. 6 taken along line 5—5 of FIG. 5, shows a plurality of filing bars 24 with two of the center bars being separated the maximum possible distance to permit searching and viewing documents 16 hanging on pins 42 located therebetween. Dimension "A" shows the overlap distance between the ends of the pins 42 with the safety block 32 in the down position, indicating that documents 16 cannot fall or be removed in this position. Pins 42 are attached to the filing bars 24 by snap rings 50 as shown. The opening 30 in the U-channel through which the blocks 22 fit is again shown. For completeness, filing bars 24 are shown housed in the cabinet. Also shown are handle 34, cabinet extension 48, cabinet front panel 54, magnet 40, cabinet back 20, lid hinge 52, cabinet lid 14 and U-channel support 60.

Figure 7:
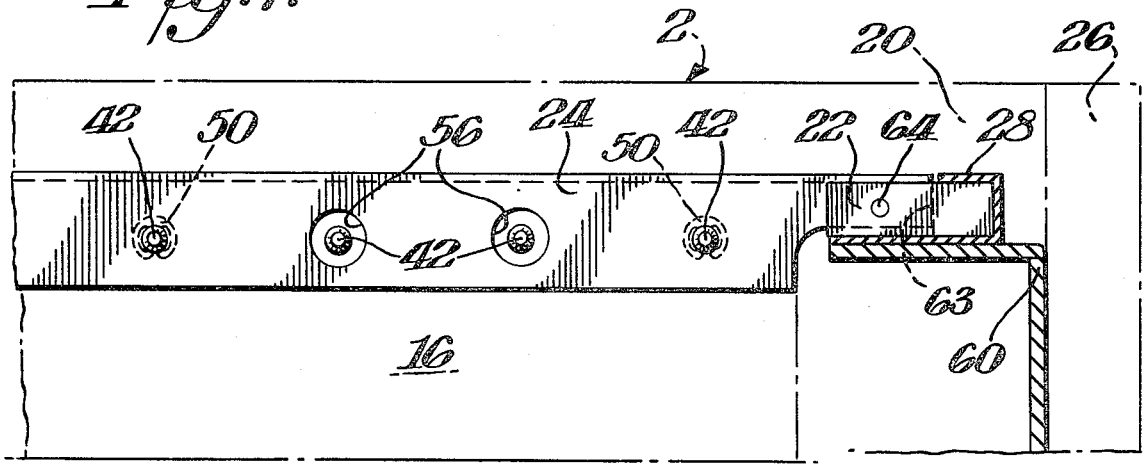
FIG. 7 is a partial exploded elevation view, in part cross-section, taken along line 7—7 of FIG. 5.

FIG. 7 taken along line 7—7 of FIG. 5 illustrates the operation of slide block 22 in U-channel 28 in detail. Pins 42 extend perpendicularly from the file bar 24 as shown and pins 42 from adjacent bars are shown extending into holes 56. Snap rings 50 secure the pins 42 to the file bars as shown. Document 16 hangs vertically on pins 42. Retainer pin 64 secures file bar 24 within the slots 63 of blocks 22 which slide within U-channel 28. The U-channel 28 is attached to the U-channel support 60.

Figure 8:
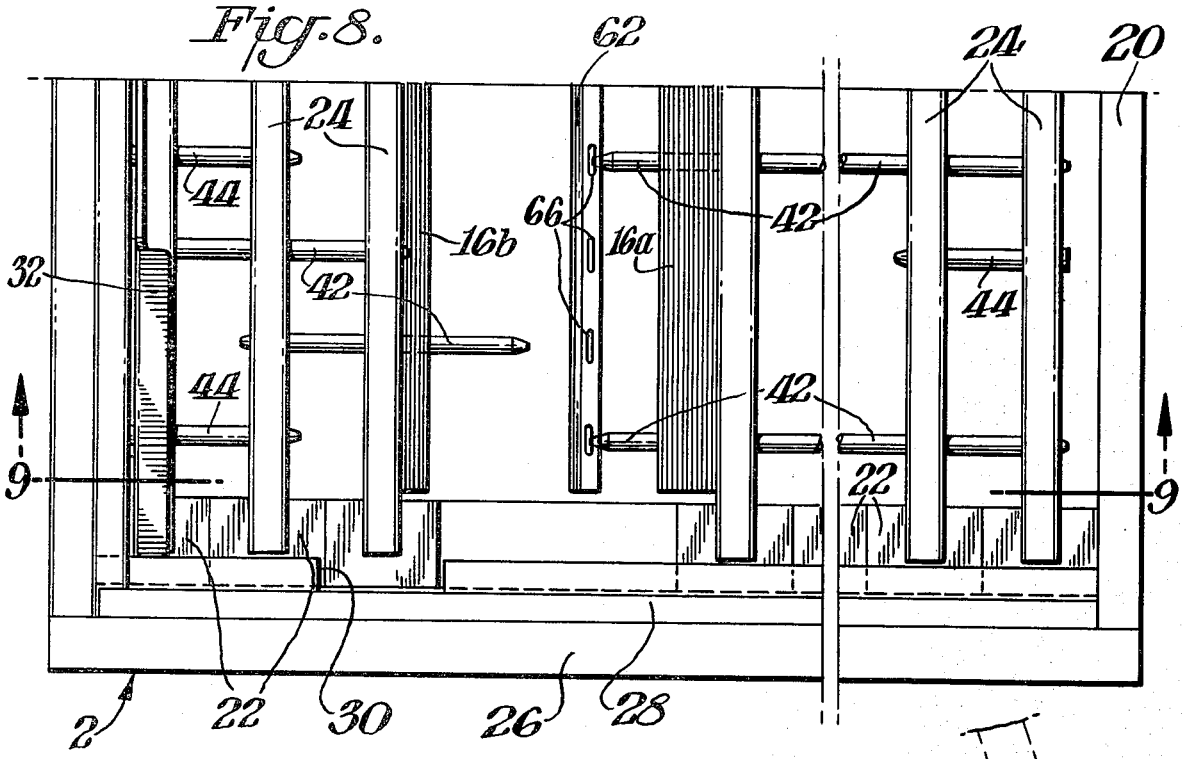
FIG. 8 is a partial top view of the filing bars and pin arrangement of this invention with the safety block in the open position and two of the filing bars separated to their maximum separation distance to permit removal of a document located therebetween.

FIG. 8 shows the safety block 32 in the open or up position. In this position, any two filing bars 24 can be separated the maximum permissible separation. With the filing bars 24 separated as shown, the ends of pins 42 no longer overlap in the gap between bars 24 wherein the documents 16 are hanging, and the document 62 can be removed (or filed). The documents 16 are separated into two groups, **16*a* and 16*b*. Documents 16*a* hang on pins 42 extending from one bar 24 and documents 16*b* hang from the pins 42 on the adjacent bar 24. The holes 66 in the document 62 being removed are shown for completeness of illustration. Also shown are the slide blocks 22 for holding the filing bars 24 sliding within the U-channel 28 and the opening 30 in the U-channel 28 through which blocks 22 can be removed. In this figure, the cabinet structure, i.e. cabinet 2, cabinet side 26 and cabinet back 20**, are indicated for orientation.

FIG. 9 taken along line 9—9 of FIG. 8 shows document 62 being removed by hand. The documents between the filing bars 24 where the desired document is located are shown separated into two groups **16*a* and 16*b* with the desired document at the separation point. The safety block 32 is in the up position using hinge 36 mounted to the cabinet front extension 48. The safety block 32 is held in the up position by magnet 40. Pins 42, which are attached to the file bars 24 by snap rings 50, are separated such that a gap exists between the pin ends as shown and document 62 is easily removed. Adjacent slide blocks 22 between which the documents are located are shown separated their maximum possible separation distance with safety block 32** up. The remaining components of the filing system, described previously, are included for completeness.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

What is claimed is:

1. A vertical filing system wherein filed documents are suspended vertically on a plurality of coacting, substantially horizontal pins, said pins and associated components of the filing system being contained in a filing cabinet which may be either a top opening type or a drawer opening type cabinet, said filing system comprising:

a plurality of substantially horizontal and substantially parallel file bars having pins extending perpendicularly through said bars and protruding outwardly therefrom, the pins extending from any one bar being offset from the pins of any other adjacent bar, the space between each pair of said bars being used to file documents therein by hanging said documents on the said pins extending into said space from each bar at each end of said space, and means for slideably moving said file bars toward and away from each other within said cabinet, and means to vary the possible separation distace between any two of said file bars from a minimum, specified, closed distance to an intermediate, specified, search distance and to a maximum, specified, open distance, the lengths of said pins being such that, when the file bars are at said minimum closed distance, or at said intermediate search distance, said pins extending into said space from one said bar overlap said pins extending in the opposite direction into said space from an adjacent bar, thereby prohibiting the fall or removal of filed documents from said space and providing effective storing thereof, and the lengths of said pins being such that, when the file bars are at said maximum, open distance, said pins extending into said space from one said bar do not overlap said pins extending in the opposite direction into said space from an adjacent bar, wherein said pins are located on each said filing bar and openings are placed in each said bar through which pins of adjacent bars can extend such that, on each bar other than the first and last bar, the pin-opening sequence is pin-opening-opening across the entire bar, the first and last bars having pins and openings to accomodate the internal bars, thereby providing for vertical filing or removal of said documents within or from said space.

2. The filing system of claim 1 wherein said means to vary the possible separation distance between any two of said file bars comprise at least one safety block insertable and removable from the space between said cabinet wall and first or last of said file bars, whereby when said safety block is inserted, said pins overlap in each said space and when said safety block is removed, said pins do not overlap in at least one of said spaces between filing bars.

3. The filing system of claim 2 wherein means are provided for holding said safety block in the open position.

4. The filing system of claim 3 wherein said means for holding said safety block in the open positon comprise a magnet.

5. The filing system of claim 1 wherein the pin-opening arrangement is such that in one internal bar the sequence is pin-opening-opening, and in the next adjacent bar the sequence is opening-pin-opening, and in the next adjacent bar the sequence is opening-opening-pin, repeating such sequence for all bars in said system.

6. The filing system of claim 1 having eleven filing bars and ten filing spaces located between said bars.

* * * * *